US005968349A

United States Patent [19]

Duyvesteyn et al.

[11] Patent Number: 5,968,349

[45] Date of Patent: Oct. 19, 1999

[54] EXTRACTION OF BITUMEN FROM BITUMEN FROTH AND BIOTREATMENT OF BITUMEN FROTH TAILINGS GENERATED FROM TAR SANDS

[75] Inventors: Willem P. C. Duyvesteyn; Julia Rose Budden, both of Reno, Nev.; Merijn Amilcare Picavet, Delft, Netherlands

[73] Assignee: BHP Minerals International Inc., Reno, Nev.

[21] Appl. No.: 09/192,892

[22] Filed: Nov. 16, 1998

[51] Int. Cl.[6] ..... C10G 1/04; C10G 32/00

[52] U.S. Cl. ..... 208/390; 208/45; 435/281

[58] Field of Search ..... 208/390, 45, 86, 208/87; 435/281

[56] References Cited

U.S. PATENT DOCUMENTS

| | | | |
|---|---|---|---|
| 3,997,398 | 12/1976 | Zajic et al. | 195/28 R |
| 4,349,633 | 9/1982 | Worne et al. | 435/281 |
| 4,640,767 | 2/1987 | Zajic et al. | 208/390 |
| 4,648,964 | 3/1987 | Leto et al. | 208/390 |

*Primary Examiner*—Bekir L. Yildirim

*Attorney, Agent, or Firm*—Hopgood, Calimafde, Kalil & Judlowe

[57] ABSTRACT

A process for the extraction of bitumen from bitumen froth generated from tar sands is disclosed. In this process, bitumen froth is extracted from tar sands using a water process without requiring the use of caustic soda. The froth is treated in a counter-current decantation circuit with a paraffinic solvent to remove precipitated asphaltenes, water, and solids from the bitumen froth. A dilute bitumen product is produced having final water and solids contents of about 0.01 to about 1% by weight. This renders the dilute bitumen product amenable to direct hydrocracking. The process provides an alternative route to the conventional process of utilizing centrifuges to separate bitumen from precipitated asphaltenes, water, and solids and thus avoids the high capital and operating costs associated with the conventional bitumen froth treatment by centrifugation. The invention utilizes bitumen froth produced from a water process in which the use of caustic soda is not required. The process advantageously avoids the production of tailings sludges caused by clay dispersions. The present invention also teaches a novel process for the biotreatment of bitumen froth tailings resulting in a reduced amount of waste products and waste byproducts.

36 Claims, 1 Drawing Sheet

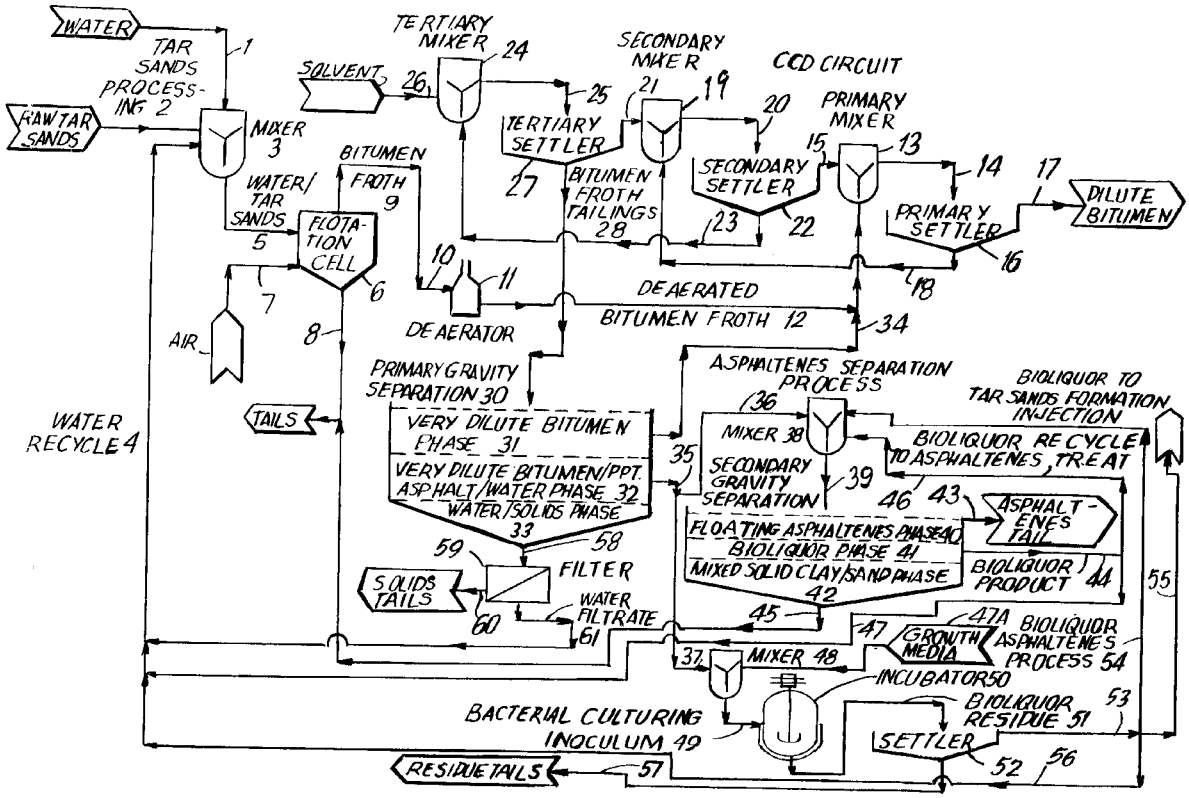

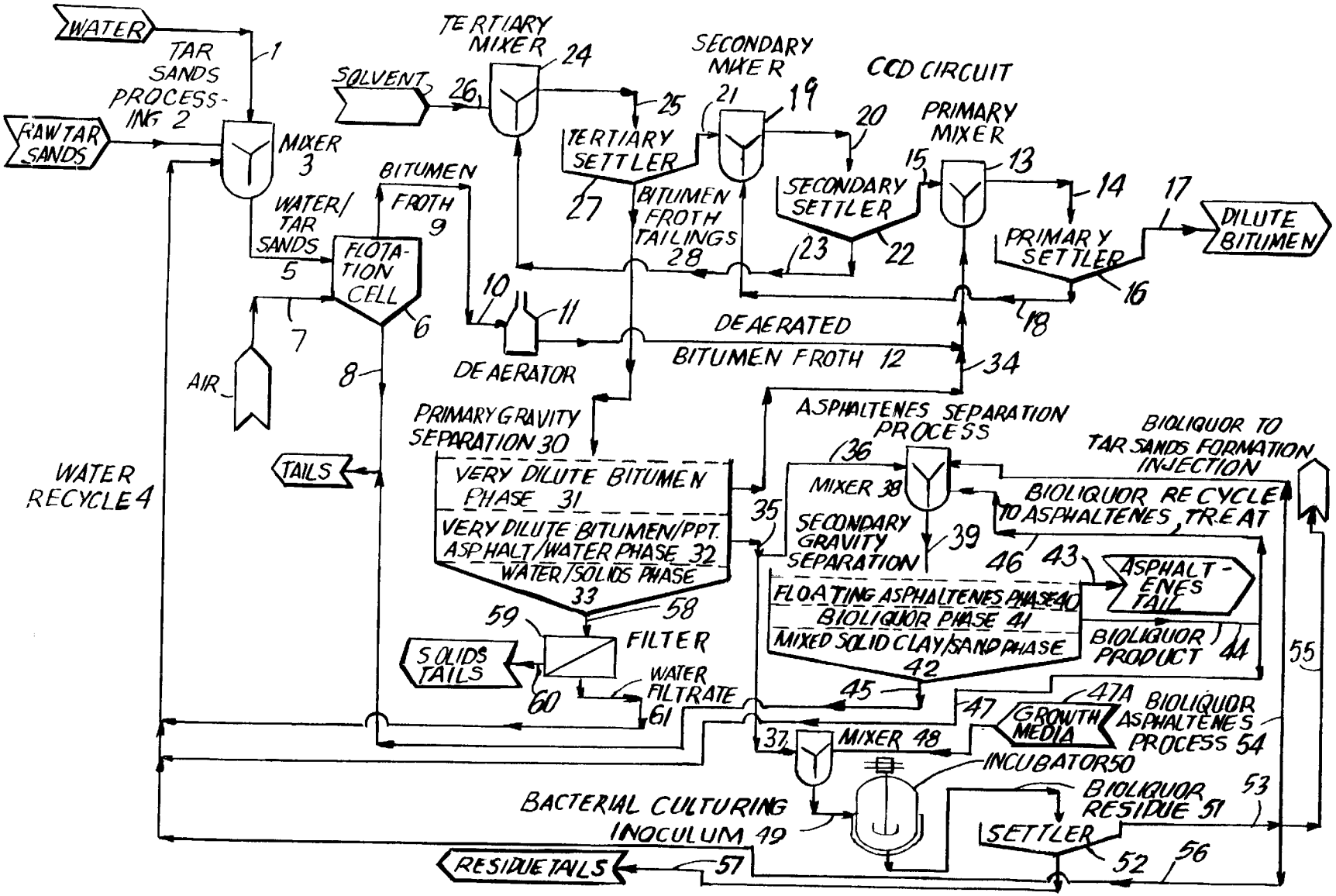
WATER
RAW TAR SANDS
TAR SANDS PROCESSING 2
MIXER 3
WATER/TAR SANDS 5
FLOTATION CELL 6
AIR
BITUMEN FROTH 9
SOLVENT
TERTIARY MIXER 24
TERTIARY SETTLER 27
SECONDARY MIXER 19
SECONDARY SETTLER 22
PRIMARY MIXER 13
PRIMARY SETTLER 16
CCD CIRCUIT
DILUTE BITUMEN 17
BITUMEN FROTH TAILINGS 28
DEAERATED BITUMEN FROTH 12
DEAERATOR 11
TAILS
WATER RECYCLE 4
PRIMARY GRAVITY SEPARATION 30
VERY DILUTE BITUMEN PHASE 31
VERY DILUTE BITUMEN/PPT. ASPHALT/WATER PHASE 32
WATER/SOLIDS PHASE 33
ASPHALTENES SEPARATION PROCESS
MIXER 38
SECONDARY GRAVITY SEPARATION
FLOATING ASPHALTENES PHASE 40
BIOLIQUOR PHASE 41
MIXED SOLID CLAY/SAND PHASE 42
BIOLIQUOR TO TAR SANDS FORMATION INJECTION
BIOLIQUOR RECYCLE TO ASPHALTENES TREAT
ASPHALTENES TAIL
BIOLIQUOR PRODUCT
BIOLIQUOR ASPHALTENES PROCESS 54
GROWTH MEDIA
INCUBATOR 50
MIXER 48
BIOLIQUOR RESIDUE 51
SETTLER 52
FILTER
WATER FILTRATE
SOLIDS TAILS
BACTERIAL CULTURING INOCULUM 49
RESIDUE TAILS

EXTRACTION OF BITUMEN FROM BITUMEN FROTH AND BIOTREATMENT OF BITUMEN FROTH TAILINGS GENERATED FROM TAR SANDS

FIELD OF THE INVENTION

The present invention relates to a tar sands extraction process and, in particular, to a counter-current decantation (CCD) process for the extraction of bitumen from bitumen froth generated from tar sands using a water process coupled with the biotreatment of the bitumen froth tailings produced therefrom.

BACKGROUND OF THE INVENTION

Throughout the world, considerable oil reserves are locked in the form of tar sands, also called bitumen sands. For example, the Athabasca tar sands deposit, located in northeastern Alberta, Canada, is the largest of the four major Alberta deposits and contains oil reserves substantially exceeding 150 billion barrels over a total area of 32,000 square kilometers. Another such tar sands deposit exists in the Tar Sand Triangle located in a triangularly shaped area between the Dirty Devil River and the Colorado River in southeastern Utah. The Tar Sand Triangle deposit contains reserves of 12–16 billion barrels of oil in place and covers an area of approximately 518 square kilometers. However, the fact that the oil, in the form of bitumen, is intimately mixed with sand, water, sand silt, complicates the problem of extracting oil therefrom.

Various methods have been proposed to separate the bitumen product from the tar sands as a single component. In one method, the bitumen separated from the sands is coked to produce coker distillate which may be later refined in accordance with conventional refinery practice. In the alternative, it has been proposed that the raw tar sands be treated in a retort in either a moving or fluid bed to produce a coker distillate in which the coke which deposits on the sand is burned to provide process heat.

However, the foregoing processes have their disadvantages in that during coking, the distillate is cracked. While cracking may be desirable for obtaining economic yields, there is usually some degradation of the distillate quality.

One attempt to overcome these disadvantages is disclosed and claimed in U.S. Pat. No. 2,871,180. The method described in this patent for separating crude oil from bituminous sands in a deasphalted oil enriched layer and an asphaltene enriched layer is to provide an aqueous pulp of the sands into a vertical extraction zone. A low molecular weight paraffinic hydrocarbon (propane) is then introduced into the extraction zone at a level below the point of introduction of the aqueous bituminous sand pulp.

Essentially, the low molecular weight paraffinic hydrocarbon flows upwardly through the extraction zone while the heavier aqueous bituminous sand pulp flows downwardly. These opposing upward and downward flows result in the formation of a deasphalted oil and solvent phase (i.e., the product phase), an asphaltenes phase diluted with a lesser portion of the solvent, a water phase, and a substantially oil-free sand phase, said phases having increasing specific gravities in the order presented. The phases are then removed for further treatment. However, this process presented several economic disadvantages that limited its use and commercial applicability.

Conventionally, the hot water extraction process, which avoids some of the disadvantages presented by the above methods, is utilized in the recovery of bitumen from the sand and other material in which it is bound. After the bitumen is recovered, it is then treated to obtain oil products therefrom. One such example of this process is disclosed in U.S. Pat. No. 5,626,793, which is incorporated herein by reference.

According to the prior art water extraction process, tar sands are first conditioned in large conditioning drums or tumblers with the addition of caustic soda (NaOH) and water at a temperature of about 85° C. The tumblers provide means for steam injection and positive physical action to mix the resultant slurry vigorously, causing the bitumen to be separated and aerated to form a bitumen froth.

The slurry from the tumblers is then screened to separate out the larger debris and passed to a separating cell where settling time is provided to allow the slurry to separate. As the slurry settles, the bitumen froth rises to the surface and the sand particles and sediments fall to the bottom. A middle viscous sludge layer, referred to as middlings, contains dispersed clay particles and some trapped bitumen that is not able to rise due to the viscosity of the sludge. Once the slurry has settled, the froth is skimmed off for froth treatment and the sediment layer is passed to a tailings pond. The middlings is often fed to a secondary flotation stage for further bitumen froth recovery.

U.S. Pat. No. 5,626,743 discloses a modified prior art hot water extraction process which is referred to as the hydrotransport system. In this system, the tar sands are mixed with water and caustic soda at the mine site and the resultant slurry is transported to the extraction unit in a large pipe. During the hydrotransport, the tar sands are conditioned and the bitumen is aerated to form a froth. This system replaces the manual or mechanical transport of the tar sands to the extraction unit and thus eliminates the need for tumblers.

The bitumen froth from either process contains bitumen, solids, and trapped water. The solids that are present in the froth are in the form of clays, silt, and some sand. The froth contains about 60% by weight bitumen which is composed of about 10 to 20% by weight asphaltenes, about 30% by weight water, and about 10% by weight solids. From the separating cell, the froth is passed to a defrothing or deaerating vessel where the froth is heated and broken to remove the air. Typically, naptha is then added to solvate the bitumen thus reducing the density of the bitumen and facilitating separation of the bitumen from the water and solids by means of a subsequent centrifugation treatment. The bitumen collected from the centrifuge treatment usually contains about 5 wt % water and solids and may be passed to the refinery for upgrading and subsequent hydrocracking. The water and solids released during the centrifuge treatment are passed to the tailings pond.

The very nature of bitumen renders it difficult to process. This is because bitumen is a complex mixture of various organic species comprising about 44 wt % white oils, about 22 wt % resins, about 17 wt % dark oils, and about 17 wt % asphaltenes (Bowman, C. S. "Molecular and Interfacial Properties of Athabasca Tar Sands"; Proceedings of the 7th World Petroleum Congress. Vol. 3 Elsevier Publishing Co. 1967).

When bitumen is treated using the conventional naphtha dilution and centrifugation extraction process, considerable problems are encountered. The reason for this twofold: Firstly, the naphtha diluted bitumen product can contain up to 5 wt % water and solids. Secondly, the naphtha diluent solvates the bitumen as well as the unwanted and dirty asphaltenes contained in the bitumen froth. Because hydrocracking requires a homogeneous feed which is very low in solids and water, the naphtha diluted bitumen product cannot be fed directly to the hydrocracker. In order to utilize the naphtha diluted bitumen product, it must first be coked to drive off the naphtha solvent and to drop out the asphaltenes and solids. Unfortunately, this coker upgrading represents an enormous capital outlay and also results in a loss of 10–15% of the bitumen initially available for hydrocracking.

One way to avoid the problems presented by the naphtha dilution of the bitumen is to use a different solvent such as a paraffinic hydrocarbon. However, the use of a paraffinic diluent results in the precipitation of a proportion of asphaltenes from the diluted bitumen. Therefore, when the paraffinically diluted bitumen is fed to the centrifugation system, the precipitated asphaltenes may tend to "plug up" the centrifuges which results in increased maintenance due to the necessity of shutting down and cleaning the fouled centrifuges. The increased centrifuge maintenance therefore results in reduced throughput and unsatisfactory process economics. Furthermore, centrifugation equipment is highly capital and maintenance intensive even during smooth operation.

The tailings produced via the conventional extraction process present further problems. The tailings in the slimes tailings pond are largely a sludge of clays, some sand, water, and bitumen. During the initial years of residence time, some settling takes place in the lower layer of the pond, releasing some of the trapped water. The water released from the ponds can be recycled back into the water tar sands treatment process. However, the major portion of the tailings remains as sludge indefinitely. The sludge contains some bitumen and high percentages of solids, mainly in the form of suspended silt and clay.

The tailings ponds are costly to build and maintain, and the size of the ponds and their characteristic caustic condition can create serious environmental problems. In addition, environmental concerns exist with respect to the large quantities of water required for the extraction of bitumen and which remain locked in the tailings pond.

It is known that sludge is formed during the initial conditioning of the tar sands because caustic soda tends to react with clay particles. The caustic soda causes the clays, such as montmorillonite clays, to swell and disperse into platelets that are held in suspension and form a gel-like sludge. Since such sludges inhibit the flotation of the bitumen froth during the extraction process, the lower grade tar sands containing large amounts of expanding clays cannot be treated satisfactorily when using the conventional water caustic soda process.

Therefore, the need exists for an extraction process which would not require the use of caustic soda in the tar sands conditioning process in order to assure a reduction in the production of sludge and therefore an increase in the water available for recycling and to assure a decrease in the volume of tailings present in the tailings ponds. It would also be highly desirable to avoid the use of naphtha based solvents for bitumen extraction so as to preclude the necessity of coker upgrading of the bitumen product prior to hydrocracking. It would also be desirable to avoid the use of centrifuges with paraffinically diluted bitumen because of the inherent plugging of asphaltenes in the centrifuges by utilizing a non-capital intensive process which can efficiently treat a diluted bitumen containing precipitated asphaltenes while maintaining a high throughput, low maintenance, and improved process economics. Finally, it would be advantageous to treat the bitumen froth tailings produced from the bitumen extraction of tar sands and would most advantageously provide a useful product therefrom.

Processes have been proposed to utilize alternative conditioning reagents in place of caustic soda. U.S. Pat. No. 4,120,777 and U.S. Pat. No. 5,626,743, incorporated herein by reference, disclose two such processes. The former patent utilizes soluble metal bicarbonates in place of caustic soda. The latter teaches the use of mixture of sodium and potassium bicarbonates in the presence of calcium and magnesium ion sources. The aim of both of these patents is to avoid the use of caustic soda in the hot water tar sands conditioning process and therefore reduce clay dispersion and subsequent sludge formation.

U.S. Pat. No. 4,349,633 avoids the use of a conditioning reagent in the tar sands conditioning process, and instead discloses the use of a suspension of oxidase-synthesizing hydrocarbon metabolizing microorganisms to facilitate the separation or release of bitumen from the sand, clays, and water in the tar sands. This process has the disadvantage that part of the higher value, low molecular weight hydrocarbons are converted and consumed.

However, such processes have not been adopted by the industry due to the fact that they substantially increase the cost of bitumen extraction from tar sands and also due to the higher cost of reagents employed. Furthermore, such processes often result in lower tar sand conditioning rates and thus adversely affect product throughput. Finally, although such processes may avoid the production of sludges and their inherent problems, none of the prior art addresses the problem of coker upgrading of naphtha diluted bitumen or the centrifuge plugging which occurs using paraffinically diluted bitumen, or the treatment of the bitumen froth tailings using biochemical process.

THE DRAWING

The figure is a flowsheet illustrating the process for carrying out the invention.

SUMMARY OF THE INVENTION

A unique, efficient, and novel process has been developed for the extraction of bitumen from bitumen froth generated from tar sands. According to the novel inventive process disclosed and claimed herein, bitumen froth is first extracted from tar sands using a warm water process. The froth is then treated in a counter-current decantation circuit utilizing a paraffinic hydrocarbon as a solvent to remove precipitated asphaltenes, water, and solids from the bitumen froth and produce a diluted bitumen product. The precipitated asphaltenes, water, and solids are then treated biochemically in order to reduce the amount of waste and also to produce a bioliquor product which can be used in the initial tar sands conditioning process and also by injection during the mining of tar sands deposits.

Surprisingly, the present invention results in the production of a final dilute bitumen product having solids and a water content of substantially less than 5% and generally about 0.01 to about 1.00% by weight which can be directly fed to a hydrocracker. This process provides an improved and alternative method to the conventional process of diluting bitumen with naphtha and, in addition, the expensive coker upgrading required to render the bitumen amenable to hydrocracking.

The invention also provides an alternative bitumen extraction process that avoids plugging of centrifuges encountered when treating paraffinically diluted bitumen products Advantageously, the present invention does not require the use of caustic soda to condition the tar sands and thereby avoids clay dispersion and the attendant formation of sludge. Moreover, temperatures much lower than 85° C. normally used can be used to treat tar sands. Typically, the tar sands conditioning step of the present invention range in temperature between approximately 25° and 55° C. and preferably at a temperature of approximately 35° C. The decrease in the temperature required for tar sands conditioning results in lower energy costs and improved process economics.

The present invention also provides a process whereby the bitumen froth tailings produced from the CCD circuit are treated biochemically using a mixed culture inherent in tar sands or a non-indigenous source. The utilization of this biotreatment step not only results in a lower waste volume due to asphaltenes usage, but also results in the production of a bioliquor which finds use in the initial tar sands conditioning process and also in the mining of the tar sands deposits and the recovery of oil or bitumen from oil reservoirs.

According to another aspect of the present invention, a process is provided for the extraction of bitumen from bitumen froth generated from a tar sands conditioning process using water without requiring the use of caustic soda. The process comprises:

(a) treating the bitumen froth concentrate in a counter-current decantation system with a hydrocarbon solvent to produce a bitumen product with substantially reduced water, solids, and precipitated asphaltenes and a bitumen froth tailings or residuum, comprising either separately or intimately mixed residual bitumen, solvent, water, solids, and precipitated asphaltenes;

(b) subjecting the bitumen froth tailings comprising very dilute bitumen, solvent, water, solids, and precipitated asphaltenes, to a first gravity separation step and thereby form a dilute bitumen phase, a mixed dilute bitumen phase, precipitated asphaltenes, and water, and a water and solids phase;

(c) recycling said very dilute bitumen phase produced in the first gravity separation step to the counter-current decantation system;

(d) biochemically treating said solvent, precipitated asphaltenes, and water phase produced in step b) by isolating a mixed bacterial culture therefrom and inoculating said bacterial culture with a nutrient specific to the growth of the bacterial culture; a portion of said solvent, asphaltenes, and water phase to form an inoculum;

(e) incubating said inoculum in a constantly stirred, isothermal environment for an amount of time sufficient to produce a solid-liquid mixture comprising a bioliquor phase, containing biosurfactants, solvent, and water, and a solids phase, containing a reduced amount of precipitated asphaltenes and biomass;

(f) separating said solid-liquid mixture produced in step (e) thereby producing a separate bioliquor product and solid residue tailing;

(g) utilizing a portion of said bioliquor product for the initial tar sands conditioning process;

(h) utilizing a portion of said bioliquor product for the separation of asphaltenes;

(i) utilizing a portion of said bioliquor product for the mining of tar sands via direct injection of the bioliquor product into tar sands deposits; and (j) treating said water and solids phase produced in step (b) by filtration to produce filtered solids which are discarded as tails and a water filtrate which is recycled to said tar sands treatment process.

According to one embodiment of the present invention, a process is provided for the extraction of bitumen from bitumen froth produced from tar sands water conditioning counter-current decantation system by employing a paraffinic hydrocarbon as the solvent to dilute the bitumen and to substantially remove the water, solids, and precipitated asphaltenes therefrom.

According to a further aspect of the present invention, a process is provided for the extraction of bitumen from bitumen froth produced from a tar sands water conditioning process in which the paraffinic hydrocarbon solvent used in the counter-current decantation process (CCD) has a chain length from 4 to 8 carbons.

In a still further embodiment of the present invention, a process is provided for the extraction of bitumen from bitumen froth produced from water-containing tar sands in which the paraffinic hydrocarbon is a solvent comprised of a major proportion of said paraffinic solvent in intimate mixture with a minor proportion of an aromatic solvent such as cyclohexane. The amount of aromatic solvent may range up to about 30% by weight.

According to a still further aspect of the present invention, a process is provided for the extraction of bitumen from bitumen froth produced from a tar sands water conditioning process, wherein the paraffinic hydrocarbon employed as the solvent in the counter-current decantation system is comprised of a mixture of pentane and hexane.

According to a still further aspect of the present invention, a process is provided for the extraction of bitumen from bitumen froth produced from a tar sands water conditioning process, wherein the paraffinic hydrocarbon solvent comprises a mixture of about 50% by weight pentane and about 50% by weight hexane.

According to a still further aspect of the present invention, a process is provided for the biochemical treatment of the bitumen froth tailings produced from the extraction of bitumen from bitumen froth via CCD in which a mixed bacterial culture, originally present in the bitumen froth tailings, is further cultured with a nutrient, in order to provide a microorganism population useful for degrading asphaltenes and the concurrent production of a bioliquor which finds use in the initial tar sands conditioning and tar sands mining processes.

Because the present invention does not require the use of caustic soda in the initial tar sands conditioning process and utilizes a CCD circuit in place of centrifugation for bitumen recovery from the froth concentrate, bitumen is efficiently extracted from tar sands without producing clay dispersion sludges and without utilizing centrifuges which are prone to plugging by precipitated asphaltenes following dilution. Since the instant invention utilizes a paraffinic hydrocarbon as a solvent for the bitumen, an exceptionally clean diluted bitumen product having about 0.01 to about 1 wt % water and solids is obtained which may be fed directly to a hydrocracker thereby avoiding the necessity of pre-hydrocracker upgrading by means of conventional coking process. Because the instant invention utilizes a series of gravity separation stages followed by several material recycle steps coupled with the use of a biotreatment process for treating the precipitated asphaltenes waste product, a more efficient and environmentally acceptable tar sands treatment process is provided.

The objects and advantages of the instant invention will clearly appear from the following detailed description of the invention, taken in conjunction with the accompanying drawing and examples.

BRIEF DESCRIPTION OF THE DRAWINGS

The accompanying drawing is a flow sheet of the process for carrying out the present invention.

DETAILED DESCRIPTION OF THE INVENTION

The instant invention has as its main object the production of a paraffinically diluted bitumen product produced by means of a counter-current decantation system in which the solids and water content is substantially less than 5% and generally 0.01 to about 1 wt %. Thus, the diluted bitumen product can be fed directly to a hydrocracker without intermediate upgrading. As previously stated, the present invention has as its object the extraction of bitumen from bitumen froth produced in a tar sands water-conditioning process without requiring the use of caustic soda as called for in the prior art. The present invention substantially minimizes, if not avoids, the production of tailings sludge, that is to say, clay dispersions. Thirdly, by utilizing a series of gravity separation stages coupled with a novel biotreatment process and several material recycle steps for treating the precipitated asphaltenes waste product, the instant invention significantly reduces the amount of wastes produced in conventional tar sands treatment processes and produces a useful bioliquor product which may be used in the initial tar sands conditioning and tar sands mining processes. However, it should be understood that the instant invention may be used to extract bitumen and treat bitumen froth tailings from bitumen froth produced by any known means.

In the following description of the instant invention, it should be understood that the expression "paraffinic hydrocarbon" used herein refers to the light paraffinic hydrocarbon utilized in the extraction of the bitumen values from the bitumen froth.

In a preferred embodiment, the light paraffinic hydrocarbon utilized in the counter-current decantation process has a chain length from 4 to 8 carbons. In an alternate embodiment, the solvent utilized in the counter-current decantation process comprises a major proportion of a paraffinic solvent in intimate mixture with a minor proportion of a an aromatic solvent, for example, cyclohexane. In a preferred embodiment, as stated herein, the light paraffinic hydrocarbon utilized in the counter-current decantation process comprises a mixture of pentane and hexane, most preferably a mixture of about 50% by weight pentane and about 50% by weight hexane.

Referring to the flowsheet, a process flow diagram of the present invention is illustrated. A raw tar sands feed originating from a tar sands deposit is fed through a suitable conduit 2 to a tar sands conditioning mixer 3 where the raw tar sands are mixed with process water which is fed to the mixer through a suitable conduit 1 and any water recycle 4. This mixing occurs at a temperature between about 25 and 55° C. and preferably at a temperature of about 35° C. The reduced conditioning temperature, when compared to a conventional temperature of about 85° C., results in reduced energy cost and improved process economics. Furthermore, by not requiring the use of caustic soda for tar sands conditioning in mixer 3, the production of sludges through clay dispersion is substantially reduced, if not avoided.

After an amount of time sufficient to mechanically separate, by mixing, the bitumen from the tar sands solids and water, the water/tar sands slurry 5 is transported to flotation cell 6. Air transported by suitable conduit 7 to the flotation cell aerates the water/tar sands slurry producing a bitumen froth 9 and a tar sands tails which is transported to a tailings impoundment via suitable conduit.

Bitumen froth 9 produced from flotation cell 6 is then transported via a suitable conduit 10 to deaerator 11 where the froth is heated in order to release trapped air. Preferably, the deaerated bitumen froth contains about 60% by weight bitumen, which is in itself composed of about 10 to 20% by weight asphaltenes, about 30% by weight water, and about 10% by weight solids. The deaerated bitumen froth 12 produced by deaerator 11 is then fed to primary mixer 13 where it is mixed with secondary settler overflow produced from the secondary settler 22 and fed to the primary mixer through suitable conduit 15. At this point, it may be helpful to explain the general concepts of counter-current decantation (CCD) and its relation to the present invention.

The primary method of separating pregnant liquor (i.e., the diluted bitumen) from gangue (i.e., the precipitated asphaltenes, water, and solids or in other words the residuum) in the present invention is referred to as counter-current decantation (CCD). The aim of gravitational sedimentation through the use of CCD is to increase gangue concentration and to separate it from the pregnant liquor (Dahlstrohm, D. A. and Emmet, Jr., R. C. "Solid-Liquid Separations". SME Mineral Processing Handbook, Vol. 2, pp. 13-26 to 13-33. Society of Mining Engineers. 1985). However, the concentration of underflow solids or residuum in the slurry will generally range from 20–60 wt % and, therefore, contain large quantities of solution. Accordingly, this slurry is diluted again and resettled to recover further the dissolved values. As the aim of most hydrometallurgical circuits is to obtain recoveries of 95–99.5% in the final pregnant liquor, this operation must be repeated several times. If the diluting solvent were to be employed for each separation step, the pregnant liquor volume would become quite large and result in a consequent increase in recovery cost and a considerable loss in chemicals. Accordingly, a counter-current method is employed in which the solids move in the opposite direction from the liquid in a plurality of stages. The dilution solution is added to the last one or two separation stages. In the present invention, the solvent is added to the last stage. As the liquid moves forward from the last separation stage, it increases in dissolved value concentration, while the liquid portion of the solids decreases in dissolved values as it passes towards the final separation stage. Accordingly, separation is actually achieved by dilution and solids concentration through sedimentation at each stage.

Again, by inspecting the figure, the CCD circuit of the present invention can be compared to the explanation given here-in-above. As explained above, the function of the CCD circuit of the invention is to increase the concentration of the precipitating asphaltenes, solids, and water while simultaneously washing the bitumen through dilution with a solvent from the precipitated asphaltenes, solids, and water contained in the bitumen froth. The present invention, however, differs from the above description in that each separation stage or settler is coupled with a mixing stage. This is because in order for there to be adequate washing and separation of diluted bitumen from the highly viscous precipitated asphaltenes and to control the kinetics of asphaltene precipitation, (including recycle seed asphaltene) the underflow, or residuum, from each settler, excluding the bitumen froth tailings from the tertiary settler 27, must be remixed in the following mixer.

In this connection, reference is again made to the flowsheet. As explained above, the deaerated bitumen froth 12 produced by deaerator 11 is fed to primary mixer 13 where it is mixed with secondary settler overflow produced from the secondary settler 22 containing a large proportion of diluted bitumen and solvent which are fed through conduit 15 into mixer 19. During mixing in primary mixer 13, the secondary settler overflow 15, containing diluted bitumen and solvent, solvates a portion of the bitumen contained in the bitumen froth and precipitates a portion of the contained asphaltenes. This mixture then flows through conduit 14 into the primary settler 16 where the gangue, containing some bitumen, precipitated asphaltenes, water, and solids, is separated from the diluted bitumen which flows through conduit 17 and is collected as a dilute bitumen product. Surprisingly, it has been found that the dilute bitumen product contains approximately 0.01 to about 1 wt % solids and water which renders it amenable to direct hydrocracking, thereby avoiding expensive upgrading through coking.

Generally, the dilute bitumen product is substantially free of water, solids and precipitated asphaltenes and contains about 500 to about 10,000 parts-per-million of solids and preferably 500 to 1,000 parts-per-million of solids.

It is also important to point out that the dilute bitumen product contains a solvent to bitumen ratio of about 2 to 1. By controlling the solvent to bitumen ratio in the underflow from 1:1 to 100:1, the asphaltene precipitation can be controlled and a large amount of dirty asphaltenes is precipitated out and removed from the diluted bitumen product while the lower molecular weight asphaltenes, which add to the value of the bitumen, are conserved in the dilute bitumen product and contribute to the overall oil recoveries from the tar sands.

A proposed mechanism of this bitumen dilution and asphaltenes precipitation can be understood by first considering the makeup of the heavy hydrocarbon feedstock (i.e., the bitumen). The bitumen is essentially a mixture of a solvent, composed of light hydrocarbons and aromatics, and heavy hydrocarbons, containing the asphaltenes, which are held in solution with the lighter hydrocarbons by the aromatics. Upon the addition of a light paraffinic hydrocarbon such as pentane or hexane, which has a low solvency power for the asphaltic materials, the solvency power of the light hydrocarbons contained in the bitumen is reduced. Effectively, the addition of the light paraffinic hydrocarbon diluent results in its dissolution into the bitumen. This changes the solvent to bitumen ratio as stated herein before. Upon continued addition of the light paraffinic hydrocarbon diluent, the asphaltic materials begin to precipitate out of solution when the peptizing action of the aromatics in the feed is lost. In essence, the light paraffinic hydrocarbon diluent acts as an anti-solvent throwing the asphaltic materials out of the bitumen. It has been found that the highest molecular weight asphaltenes precipitation starts at a diluent to bitumen ratio of about 0.7 to 1, when hexane is utilized as the light paraffinic hydrocarbon diluent.

As more hydrocarbon diluent is added, further precipitation of the asphaltenes will occur. However, continued increases in the amount of diluent added results in the re-dissolving of some of the earlier precipitated lower molecular weight materials. This is because the light paraffinic hydrocarbon diluent is an anti-solvent. However, it has some solvency power for the heavy hydrocarbon material, and if present in excess, will start to dissolve more of the precipitated heavy hydrocarbons until it is saturated. The point at which the light paraffinic hydrocarbon diluent switches from an anti-solvent to a solvent occurs at a diluent to bitumen ration of about 2 to 1.

Because the present invention utilizes the asphaltenes precipitation phenomena which occurs at a low diluent ratio for effective bitumen extraction, a reduction in the amount of diluent to be pumped around the system and ultimately recovered is achieved. This is a definite advantage of the invention because a low inventory of diluent results in a commercial scale plant with smaller unit operations rendering the process less capital intensive. Furthermore, as mentioned above, the precipitation of the heaviest and dirtiest asphaltenes results in a dilute bitumen product amenable to direct hydrocracking.

Attention is again directed to the flowsheet and to primary settler 16 illustrated therein. The streams exiting primary settler 16 are dilute bitumen product 17. The primary settler underflow is transported via conduit 18 to the secondary mixer 19. Upon entering secondary mixer 19, the solids underflow from the primary settler 16 are mixed with the overflow from tertiary settler 27 and fed to the secondary settler 22 through conduit 20. The effective diluent to bitumen ratio achieved in secondary mixer 19 is approximately 20 to 1. The high diluent content of the tertiary settler overflow acts to dissolve a large proportion of the hydrocarbons contained in the primary settler underflow via the mechanism explained above.

The mixture produced in secondary mixer 19 is then transferred via conduit 20 to the secondary settler 22 for separation again into a diluted bitumen and diluent phase and a solids phase. The diluted bitumen and diluent phase exiting the secondary settler 22 through conduit 15 enters primary mixer 13 for mixing with the deaerated bitumen froth 12. The underflow from the secondary settler 22 is transferred through conduit 23 to the tertiary mixer 24.

Upon entering tertiary mixer 24, the solids underflow from the secondary settler 22 is mixed with fresh solvent and fed to the tertiary mixer through conduit 26. The effective diluent to bitumen ratio achieved in tertiary mixer 24 is approximately 70 to 1. This extremely high diluent to bitumen ratio acts to scrub the solids underflow of secondary settler 22 by dissolving a major proportion of the contained hydrocarbons but excluding the dirtiest and heaviest precipitated asphaltenes. In this way, all of the valuable hydrocarbons contained in the bitumen are extracted leaving behind only those hydrocarbons which are extremely heavy and dirty and which, if extracted, would render the dilute bitumen product unsuitable for direct hydrocracking.

After mixing in tertiary mixer 24, the mixture is transferred via conduit 25 to the tertiary settler where the diluted bitumen and diluent phase is separated from the solids phase containing the heaviest and dirtiest asphaltenes, sand, clay, silt, water, residual bitumen, and diluent. The overflow from tertiary settler 27 flows through conduit 21 into the secondary mixer 19 where it is mixed with the underflow from the primary settler 16.

The underflow, or residuum, from the tertiary settler 27, now termed bitumen froth tailings 28, is then transferred to the primary gravity separation 30 where the bitumen froth tailings 28 separate into three separate phases; the very dilute bitumen phase 31, the very dilute bitumen/precipitated asphaltenes/water phase 32, and a water/solids phase 33. From the primary gravity separation 30, the very dilute bitumen phase 31 is transferred via conduit 34 and combined with the deaerated bitumen froth 12 entering the primary mixer 13 of the CCD circuit. The very dilute bitumen/precipitated asphaltenes/water phase 32 is transferred via conduit 35 to the asphaltenes separation process and bacterial culturing with the water/solids phase 33 exiting the primary gravity separation 30 via conduit 58 to the filter 59.

The water/solids phase 33 entering the filter 59 is filtered to produce a solids tails containing sand, clays, and silt, and a water filtrate. The solids tails exiting filter 59 are conveyed to tailings impoundment through conduit 60. The water filtrate produced by filter 59 is transferred through conduit 61 into water recycle conduit 4, returning it to tar sands processing mixer 3.

The very dilute bitumen/precipitated asphaltenes/water phase 32 is transferred through conduit 35 where it is split into two streams; that is, through conduits 36 and 37A. A portion of the stream is transferred through conduit 36 to asphaltenes separation mixer 38 and the remaining portion is transferred through conduit 37 to bacterial culturing mixer 48.

The floating asphaltenes phase 40 is transferred via conduit 43 to asphaltene tails and/or recycled back to the CCD circuit through primary mixer 13 by at least one valve and connecting conduit not shown. The recycled portion of asphaltenes may be used as seed to control the precipitation kinetics of asphaltenes.

Stream 37 entering mixer 48 is mixed with growth media or nutrient 47 to produce a bacterial inoculum which exits mixer 48 through conduit 49 and enters incubator 50. The function of incubator 50 is to increase the population of the mixed bacterial culture initially present in the very dilute bitumen/precipitated asphaltenes/water phase by incubating the bacteria in the presence of the growth media or nutrient 47 at constant temperature and for an amount of time to produce a bioliquor containing an increased concentration or population of microorganisms and a residue consisting of a reduced amount of asphaltenes.

This process of asphaltenes degradation and biosurfactant production taught by the instant invent ion consists of three basic steps: mixed bacterial population development, asphaltenes degradation via hydrocarbon metabolization with the produced mixed bacterial culture, and the subsequent production of a biosurfactant containing the bioliquor by-product.

The microorganisms utilized in this process are referred to as a "mixed bacterial culture" because they exist as a consortium of different microorganism species. The type and relative amount of each microorganism species present in the "mixed bacterial culture" is a function of both the tar sands origin, overall composition, and bacterial incubation procedures. In general, the microorganisms making up the mixed bacterial culture are those microorganisms naturally present in the tar sands.

It should be understood, however, that other hydrocarbon metabolizing microorganisms which are useful in the degradation of asphaltenes may be added to the process as pure or mixed cultures from a source which may be external from that of the tar sands themselves. Thus, microorganisms may be utilized in the present invention either as pure cultures, or as mixed cultures, so as to provide optimal results in achieving a satisfactory level of asphaltenes degradation and biosurfactant production from tar sands obtained from any specific geological location.

The microorganisms identified and isolated for use in the instant invention as hydrocarbon metabolizing microorganisms are listed in Table 1.

TABLE 1

Identification of Isolated Hydrocarbon Metabolizing Microorganisms

| | |
|---|---|
| Pseudomonas | aeruginosa |
| | arvilla |
| | alkanolytica |
| | cresorensis |
| | dacunhae |
| | desmolyica |
| | oleovorons |
| | putida |
| | rathonis |
| | salopia |
| | chloroaphis |
| | sp. |
| Corynebacterium | hydrocarboclastus |
| | hydrocarboaxydans |
| | peirophilum |
| | diaxydans |
| | alkatrum |
| | sp. |
| Flavobacterium | axydans |
| | devorons |
| | resinovorum |
| | sp. |
| Rhodococcus | rhodochrous |
| Bacillus | sphaericus |
| Nocardia | butanica |
| | corallina |
| | hydrocarbonoxydans |
| | paraffinca |
| | opaco |
| | salmonicolor |
| | rubra |
| | rubropertincta |
| | amarae |
| | aurontia |
| | erythropolis |
| | minima |
| | neopaca |
| | keratolytica |
| | petroleophila |
| | sp. |
| Arthrobacter | paruffineus |
| | hydrocarboglutamicu |
| | oxydans |
| | simplex |
| | alkanicus |
| | sp. |
| Micrococcus | glutamicus |
| | paraffinolyricus |
| | auratiocus |
| | cerificans |
| | conglomeaius |
| | varlans |
| | sp. |
| Mycobacterium | aurum |
| | chitae |
| | cunearum |
| | paraffinicum |
| | phlei |
| | petroleophilum |
| | rhodochrous |
| | novum |
| | thermoresistibile |
| | terrae |
| | sp. |
| Streptomyces | argentelus |
| | aureus |
| | californicus |
| | fradiae |
| | griseus |
| | sp. |
| Achromobacter | paraffinoclastus |
| | cycloclasies |
| | delicatulus |

TABLE 1-continued

| Identification of Isolated Hydrocarbon Metabolizing Microorganisms |
|---|
| nitriloclasies |
| paravulus |
| pestifer |
| sp. |

The microorganisms identified may be cultured in an aqueous growth medium containing required quantities of nutrients such as nitrogen, phosphates, alkali metal salts, trace elements, etc.

Preferred nutrients include $Na_2SO_4$, $MgSO_4.7H_2O$, KCl, $FeSO_4.7H_2O$, and $K_2HPO_4$. Most preferably, these nutrients are present in the following amounts: about 3.0 grams $Na_2SO_4$ per liter of water, about 0.5 grams $MgSO_4.7H_2O$ per liter of medium, about 0.5 grams KCl per liter of medium, about 0.01 grams $FeSO_4.7H_2O$ per liter of medium and about 1.0 gram $K_2HP_4$ per liter of medium. However, it should be understood that growth medium may contain any nutrient source so long as the amount of nutrient required by the microorganism for efficient growth and maintenance is supplied.

However, it should be noted that the growth medium itself contains no carbon source, which is required for proper cell growth and maintenance. This is because the carbon source utilized in the microorganism incubation is the precipitated asphaltenes contained in the bitumen froth tailings transferred to the asphaltenes separation and bacterial culturing processes. It should also be noted that the precipitated asphaltenes reporting to these bacterial processes contains an amount of very dilute bitumen which is composed of bitumen diluted in pentane and hexane. The pentane and hexane, because they are low molecular weight alkanes, provide an easily assimilable carbon source for the microorganisms. Once these lower molecular weight hydrocarbons have been metabolized, the microorganisms then begin to utilize the precipitated asphaltenes as the carbon source. This results in increased microorganism populations while at the same time resulting in reduced amounts of precipitated asphaltenes.

The growth medium is incubated after inoculation with a culture of microorganisms contained in a portion of the very dilute bitumen/precipitated asphaltenesiwater phase 32 produced in primary gravity separation 30 for a sufficient period of time to allow microorganism growth. The microorganisms may be cultured to a high concentration to form a stock solution and may also be cultured until a suitable microorganism population, or concentration, is achieved.

After culturing, the bioliquor and residue mixture produced in incubator 50 is then transferred via conduit 51 to settler 52 thereby producing a clarified bioliquor product 53 and a residue underflow which is transferred through conduit 57 as residue tails.

The microorganism culture suspension produced, termed "bioliquor", may be utilized in the initial tar sands conditioning process from which the bitumen froth feed for CCD bitumen extraction is produced or may be utilized in the recovery of the tar sands themselves wherein the bioliquor is injected into the tar sands formation prior to mining.

The bioliquor is amenable to tar sands conditioning and mining because the bioliquor contains a number of biochemically produced surfactants, termed "biosurfactants", which are useful in that they enable the bitumen contained in the tar sands to be more efficiently separated from the clay and sands solids.

The bioliquor product exiting settler 52 through conduit 53 is then split into three streams through conduits 54, 55, and 56. The bioliquor transferred in stream 55 reports directly to the tar sands mining process where the bioliquor is injected into the tar sands formation. In this way, the bioliquor renders the tar sands more amenable to processing prior to mining by substantially separating the bitumen from the sands and clays contained therein.

The bioliquor transferred via conduit 56 is combined with water recycle 4 and reports to the tar sands processing. As mentioned hereinbefore, the biosurfactants contained in the bioliquor product are useful in that they enable the bitumen contained in the tar sands to be more efficiently separated from the clay and sands solids also contained in the tar sands. Thus the initial tar sands processing step from which the bitumen froth is generated can be done at low temperatures without the conventional by use of caustic soda. In this way, the tar sands tails, produced in flotation cell 6 do not contain dispersed clays which would hinder the settling of the solids in the tar sands tailings impoundment. Furthermore, the use of the bioliquor in the initial tar sands processing results in lower bitumen losses to tails and higher levels of bitumen froth production.

Because the production of bioliquor is the direct result of asphaltenes degradation, that is, the bacterial mixture utilizes the asphaltenes as an energy source, the amount of asphaltenes waste produced can be reduced or totally eliminated through bioliquor production. Therefore, the bioliquor transferred through conduit 54 reports to an asphaltenes separation process where it is mixed with a portion of the very dilute bitumen/precipitated asphaltenes/water phase 36 in mixer 38. After combination and agitation in mixer 38, a mixture comprising a reduced amount of asphaltenes, bioliquor and solids (sands and clays) is transferred via conduit 39 to a gravity separator which produces a floating asphaltenes phase 40, a bioliquor phase 41 and a mixed sand and clay solids phase 42.

Because of the nature of the biosurfactants contained in the bioliquor, the surface chemistry of the precipitated asphaltenes contained in stream 36 entering mixer 38 are altered causing the precipitated asphaltenes to float. Furthermore, as the surface chemistry is altered, a portion of the precipitated asphaltenes are consumed thus resulting in a reduced amount of precipitated asphaltenes that is easily separated from the mixture. The floating asphaltenes phase 40 produced in the gravity separator are then transferred via conduit 43 to an asphaltenes tailings impoundment or can be added to mixer 37 to obtain a larger production of bioliquor.

The bioliquor product produced in the asphaltenes separation process 41 is transferred via conduit 44 with a portion of the bioliquor being recycled for asphaltenes treatment in mixer 38 via conduit 46, a portion of the bioliquor contained in stream 44 being transferred to the initial tar sands processing step via conduit 47.

The process of the present invention is further described in the following examples, which are non-limiting with respect to the scope of the process of the present invention.

EXAMPLE 1

This example illustrates the product streams produced by the present invention. The deaerated bitumen froth utilized as feed in this example was prepared from an Athabasca tar sands sample which was treated in a water conditioning process without the use of caustic soda. In this example, the paraffinic hydrocarbon utilized as the solvent in the three-stage countercurrent decantation process was comprised of a mixture of about 50% by weight pentane and about 50% by weight hexane with the extraction proceeding at a temperature of about 25° C.

After extraction, the $C_5$ asphaltenes content of the bitumen froth feed, the diluted bitumen product, and bitumen froth tailings was determined by dissolving a portion of each in an excess amount of pentane. The amount of asphaltenes precipitated from each of these components was then separated and weighed giving the relative $C_5$ asphaltenes contents of each of the streams.

The bitumen, water and solids contents of the bitumen froth feed, the diluted bitumen product, and bitumen froth tailings were determined utilizing the Dean Stark method. The mass distributions of solvent, bitumen, water, solids, and $C_5$ asphaltenes in the solvent feed, bitumen froth feed, dilute bitumen product, and bitumen froth tailings are given below in Table 2.

TABLE 2

Mass Distributions of Components

| Stream | Solvent (g) | Bitumen (g) | Water (g) | Solids (g) | $C_5$ Asphaltenes (g) | Total (g) |
|---|---|---|---|---|---|---|
| Solvent Feed | 1148.00 | 0.00 | 0.00 | 0.00 | 0.00 | 1148.00 |
| Bitumen Froth Feed | 0.00 | 490.00 | 184.00 | 172.00 | 147.00 | 993.00 |
| Dilute Bitumen Product | 1013.77 | 457.72 | 0.05 | 0.05 | 98.00 | 1569.59 |
| Bitumen Froth Tailings | 134.23 | 32.28 | 183.95 | 171.95 | 49.00 | 571.41 |

As can be seen from Table 2, above, the majority of the bitumen contained in the bitumen froth reported to the dilute bitumen product while the water and solids contained in the feed reported to the bitumen froth tailings. The weight percentages of each of the components contained in the dilute bitumen product and bitumen froth tailings are given in Table 3, below:

TABLE 3

Weight Percentage Distribution of Components

| Stream | Solvent (%) | Bitumen (%) | Water (%) | Solids (%) | $C_5$ Asphaltenes (%) |
|---|---|---|---|---|---|
| Dilute Bitumen Product | 88.31 | 93.41 | 0.03 | 0.03 | 66.67 |
| Bitumen Froth Tailings | 11.69 | 6.59 | 99.97 | 99.97 | 33.33 |
| Total | 100.00 | 100.00 | 100.00 | 100.00 | 100.00 |

As can be seen from Table 3, the percentages of distribution of water and solids in the dilute bitumen product are exceptionally low rendering it amenable to direct hydrocracking. It will be noted that the invention enables the production of high-grade, very clean bitumen product and a bitumen froth tailings containing substantially all of the water and solids contaminants present in the bitumen froth.

EXAMPLE 2

This example illustrates the production of bioliquor via asphaltenes degradation and the effect of the produced bioliquor upon bitumen froth production during tar sands conditioning. In order to produce bioliquor for use in tar sands conditioning experiments, an amount of precipitated asphaltenes was inoculated with a previously isolated micro-organism culture. After incubation and asphaltenes degradation, the bioliquor was separated from the culture and set aside.

The effectiveness of the bioliquor on bitumen recovery from tar sands was determined utilizing a batch extraction unit. The batch extraction unit (BEU) is essentially an isothermal reactor agitated using an impeller made up of a hollow shaft through which air is injected. The method for determining bitumen recovery via the BEU is as follows:

(a) Heat up the conditioning vessel to the desired temperature using a water bath.

(b) Weigh 500±0.5 g of homogenized tar sand. Record weight.

(c) Weigh 150±0.5 g of conditioning liquid, e.g. tap water, bioliquor, or a mixture of both and record the weight.

(d) Heat the conditioning liquid to the desired temperature using the heated vessel.

(e) Raise vessel and lock it in uppermost position. Turn on/set impeller to 600 rpm.

(f) Add the weighed tar sand.

(g) Turn on air at source and set the air flow to 150 ml/min.

(h) Mix for 30 minutes (conditioning step) and turn off air.

(i) Weigh 900 g of tap water at the desired temperature, record weight and add to the conditioned slurry.

(l) Mix for 10 minutes (primary flotation).

(k) Stop impeller and skim off the primary froth into a preweighed jar. Record weight.

(l) Set gas flow to 50 ml/min and the impeller to 800 rpm.

(m) Mix for 5 minutes (secondary flotation).

(n) Turn off gas and stop impeller.

(o) Skim off the secondary froth into a preweighed jar. Record weight.

(p) Open bottom drain plug and drain vessel contents into a preweighed 2 liter stainless steel beaker.

(q) Rinse out sand with deionized water from a preweighed wash bottle. Calculate and record weight of the rinse water used. Allow sand to settle for about 1 minute. Decant the aqueous layer into a second preweighed 2 liter stainless steel beaker (secondary tailings). Weigh the second beaker and record the weight.

(r) Weigh the first beaker and record the weight (primary tailings).

(s) Remove vessel and impeller from the BEU stand.

(t) Wash the vessel, bottom drain plug and impeller with a toluene/isopropanol mixture (63%/37%) in a fume hood. Collect washings and discard into an organic waste drum.

(u) Make sure no air sparging holes on the impeller are clogged. If necessary clean the impeller from the inside.

After separation, the amount of bitumen separated is compared to the bitumen originally contained in the tar sands. From this, the bitumen recovery can be calculated on a percentage basis. In this example, the effectiveness of the bioliquor was compared to that of ordinary tap water at different temperatures. These results are given in Table 4, below:

TABLE 4

Conditions Applied And Results Obtained In The Bitumen Liberation Experiments

| Process Temperature (° C.) | Conditioning Liquid (150 g) | Bitumen Recovery (%) |
|---|---|---|
| 25 | Tap Water | 49.5 |
| 25 | Tap Water: Bioliquor; 1:1 | 89.6 |
| 35 | Tap Water | 85.7 |
| 35 | Tap Water: Bioliquor; 1:1 | 84.3 |
| 40 | Tap Water | 94.3 |
| 40 | Tap Water: Bioliquor; 1:1 | 95.1 |

As can be seen from Table 4 above, there were no major differences in bitumen extraction obtained with tap water vs. a 1:1 mixture of tap water and bioliquor at temperatures above 25° C. However, at a temperature of 25° C., the 1:1 mixture of tap water and bioliquor resulted in a bitumen extraction almost double that of the bitumen extraction achieved with tap water alone.

Therefore, these experiments indicate that the tar sands conditioning process can proceed at ambient temperatures, i.e., 25° C., using the bioliquor produced from asphaltenes degradation which provides bitumen extractions of upwards of about 90%. Because the tar sands conditioning process can be done at energy saving low temperatures without the conventional addition of caustic soda, bitumen froth can be generated at a significantly lower cost and without the production of clay dispersions which herefore has plagued the conventional hot water caustic soda tar sands conditioning process.

The invention, as disclosed, utilizes a series of three mixer-settler units in the CCD circuit. However, it should be understood that any number of mixer-settler pairs could be utilized depending upon the ease or difficulty of the bitumen extraction from the particular deaerated bitumen froth feed. That is, deaerated bitumen froths that are more easily treated may not require three stages and may only require two. Conversely, daerated bitumen froths representing more difficult separation could require more than three stages for effective bitumen extraction.

It should be understood that other separation methods, such as flotation, may be utilized in place of the disclosed first and second gravity separation steps for treatment of the bitumen froth tailings produced from the CCD circuit. It should also be understood that other separation methods, such as flotation, may be utilized in place of the disclosed primary gravity separation to produce a pure asphaltene product and a separate solid waste.

In summary, the countercurrent decantation process for the extraction and recovery of bitumen from tar sands is carried out by employing a series of interconnected stages extending from a first stage through at least one intermediate stage to a last stage, wherein each of said stages has a mixer associated therewith. The process comprises feeding water and raw tar sands to a mixer to form a substantially uniform aqueous tar sands mixture thereof after which the tar sands mixture is passed on to a flotation cell.

Air is injected into the flotation cell to form a bitumen froth after which the bitumen is passed on to a deaerator to form a deaerated froth. The deaerated froth is passed on to a primary mixer to form a substantially uniform mixture thereof which is fed to a primary settler to provide an overflow of dilute bitumen which is removed and collected and an underflow comprising solids, asphaltenes and residual bitumen.

The underflow from the primary settler is passed on to a secondary mixer to form a uniform mixture thereof which is then fed to a secondary setter to form an overflow containing bitumen which is fed to the primary mixer for further recovery and an underflow which is fed to a tertiary mixer. A solvent is then added to said tertiary mixer to form a mixture with the underflow from said secondary settler. The mixture is then fed to the secondary tertiary settler to provide an overflow containing bitumen which is fed to the secondary mixer to provide an underflow which is fed to a first reservoir in which gravity separation of the underflow into several layers occurs comprising (1) a top layer of dilute bitumen, (2) an intermediate layer containing dilute bitumen, precipitated asphaltenes and water, and (3) a bottom layer comprised of water and solids phase which is filtered and said solids sent to tails.

The top layer containing dilute bitumen is passed to said primary mixer for the subsequent recovery of bitumen therefrom. The intermediate layer is divided into two streams, one being fed to secondary gravity separation in a second reservoir and the other to the production of bioliquor for recycle into the countercurrent decantation process. The secondary gravity separation produces a first layer of floating asphaltenes which is sent to asphaltenes tails, a second layer comprising a bioliquor phase which is recycled to the asphaltenes separation step, and a bottom layer of clay and sand which is discarded as tails.

Thus, although the present invention has been described in conjunction with preferred embodiments, it is to be understood that modifications and variations may be resorted to without departing from the spirit and scope of the invention as those skilled in the art will readily understand. Such modifictions and variations are considered to be within the purview and scope of the present invention and the appended claims.

We claim:

1. A process for the extraction and recovery of bitumen from bitumen froth generated from tar sands and thereby produce a dilute bitumen product substantially free of water, solids, and precipitated asphaltenes, and bitumen froth tailings, said process comprising the steps of:

(a) providing an aqueous bitumen froth concentrate produced from tar sands;

(b) subjecting said bitumen froth concentrate to a countercurrent decantation process using an organic solvent and thereby producing a dilute bitumen product substantially free of water, solids, and precipitated asphaltenes and a bitumen froth tailings product, comprising either separately or intimately mixed residual bitumen, solvent, water, solids, and precipitated asphaltenes;

(c) subjecting said bitumen froth tailings to gravity separation to produce a residual bitumen phase, a solvent, precipitated asphaltenes, and water phase, and a water and solids phase;

(d) treating said residual bitumen phase produced in step (c) by recycling it to the counter-current decantation system;

(e) biochemically treating said solvent, precipitated asphaltenes, and water phase produced in step (c) by isolating a mixed bacterial culture therefrom or from a non-indigenous source by inoculating a nutrient specific to the growth of said culture with a portion of said solvent, asphaltenes, and water phase to form an inoculum;

(f) incubating said inoculum in an isothermal environment for an amount of time sufficient to produce a solid-liquid mixture comprising a bioliquor phase, containing biosurfactants, solvent, and water, and a solids phase, containing a reduced amount of precipitated asphaltenes and biomass;

(g) separating said solid-liquid mixture produced in step (f) thereby producing a separate bioliquor product and a solid residue as tailings;

(h) filtering said water and solids phase produced in step (c) to produce filtered solids which are discarded as tails and a water filtrate which is recycled to said tar sands treatment process.

2. The process as set forth in claim 1, wherein said dilute bitumen product, substantially free of water, solids, and precipitated asphaltenes, contains from about 500 to about 10,000 parts-per-million solids.

3. The process as set forth in claim 1 wherein said dilute bitumen product, substantially free of water, solids, and precipitated asphaltenes, contains from about 500 to about 1,000 parts-per-million solids.

4. The process as set forth in claim 1 wherein said dilute bitumen product, substantially free of water, solids, and precipitated asphaltenes, contains about 500 parts-per-million solids.

5. The process as set forth in claim 1, wherein said bioliquor produced is utilized for injection into an oil reservoir for the recovery of bitumen and oil.

6. The process as set forth in claim 5, wherein said oil reservoir has been partially depleted of its oil content.

7. The process as set forth in any one of claims 2, 3, or 4 wherein said dilute bitumen product, substantially free of water, solids, and precipitated asphaltenes and containing from about 500 to about 10,000 parts-per-million solids, requires no further treatment and may be directly fed to a hydrocracker.

8. The process as set forth in claim 1 wherein said bitumen froth is produced from a water-based tar sands.

9. The process as set forth in claim 8, wherein said water-based tar sands treatment process is carried out at a temperature ranging from about 35° to about 65° C.

10. The process as set forth in claim 8, wherein said bitumen froth concentrate produced from said water-based tar sands treatment is comprised of about 60% by weight bitumen, about 30% by weight water, and about 10% by weight solids.

11. The process as set forth in claim 1, wherein said solvent utilized in said counter-current decantation process is a paraffinic hydrocarbon which dilutes the bitumen and removes the water, solids, and precipitated asphaltenes therefrom.

12. The process as set forth in claim 11, wherein said paraffinic solvent has a chain length from 4 to 8 carbons.

13. The process as set forth in claim 11, wherein said solvent is comprised of a major proportion of a paraffinic hydrocarbon in intimate mixture with a minor proportion of an aromatic solvent.

14. The process as set forth in claim 12, wherein said paraffinic solvent comprises a mixture of pentane and hexane.

15. The process as set forth in claim 14, wherein said paraffinic solvent comprises a mixture of about 50% by weight pentane and about 50% by weight hexane.

16. The process as set forth in claim 7, wherein said solvent utilized in said counter-current decantation process is a paraffinic hydrocarbon which dilutes the bitumen to remove the water, solids, and precipitated asphaltenes therefrom.

17. The process as set forth in claim 16, wherein said paraffinic solvent has a chain length from 4 to 8 carbons.

18. The process as set forth in claim 16, wherein said paraffinic solvent comprises a major proportion of paraffinic solvent in intimate mixture with a minor proportion of an aromatic hydrocarbon.

19. The process as set forth in claim 17, wherein said paraffinic solvent comprises a mixture of pentane and hexane.

20. The process as set forth in claim 19, wherein said paraffinic solvent comprises a mixture of about 50% by weight pentane and about 50% by weight hexane.

21. The process as set forth in claim 1, wherein said bioliquor product produced in step (g) is again inoculated with a portion of said bitumen froth tailings and a nutrient bacterial growth media to form a second inoculum followed by incubation and separation as set forth in said steps (f) and (g), respectively, to form a second bioliquor product and a second solid bioliquor product and a second solid residue tailing.

22. The process as set forth in claim 21, wherein the production of said second bioliquor is repeated a third and fourth time, thereby producing a third bioliquor product and third solid residue tailing and a fourth bioliquor product and a fourth solid residue tailing.

23. The process as set forth in any one of claims 1, 21, 22, wherein said bioliquor product is utilized for injection into a tar sands deposit for the recovery of bitumen from tar sands, said tar sands deposit, existing at a depth which renders conventional tar sands recovery processes uneconomical.

24. The process as set forth in any of one of claims 1, 21 or 22, wherein said bioliquor product is utilized in an asphaltenes separation process by mixing said bioliquor product with a portion of said bitumen froth tailings for an amount of time and at a temperature sufficient to form a three-phase mixture comprising a floating solid asphaltenes phase, a bioliquor phase containing solvent and water, and a mixed solid clay and sand phase.

25. The process as set forth in claim 24, wherein said three-phase mixture is separated to produce solid asphaltene tailings, a bioliquor product, and a mixed solid clay and sand tailings.

26. The process as set forth in claim 25, wherein said mixture of solid clay and sand tailings is mixed with said tar sands tailings for final disposal.

27. The process as set forth in claim 26, wherein said bioliquor product is recycled to said tar sands treatment process to produce bitumen froth.

28. The process as set forth in claim 27, wherein said asphaltenes separation process is carried out at an ambient temperature and for a period of about 30 minutes.

29. The process as set forth in claim 28, wherein said water-based tar sands treatment process is carried out at a temperature from about 25° C. to about 55° C.

30. The process as set forth in claim 1, wherein said nutrient is a liquid mineral salt.

31. The process as set forth in claim 30, wherein said liquid mineral salt nutrient is free of organic carbon source materials.

32. The process as set forth in claim 31, wherein said liquid nutrient contains about 3.0 grams $Na_2SO_4$ per liter of solution, about 0.5 grams $MgSO_4.7H_2O$ per liter of solution, about 0.5 grams KCl per liter of solution, about 0.01 grams $FeSO_4.7H_2O$ per liter of solution and about 1.0 gram $K_2HPO_4$ liter of solution.

33. The process of claim 1, wherein the bacterial culture is selected from the group consisting of Pseudomonas sp., Comebactelium sp., Flavobacterium sp., Nocardia sp., Arthrobacter sp., Micrococcus sp., Mycobacterium sp., Streptomyces sp., and Achromobacter sp.

34. The process of claim 1, wherein said bacterial culture comprises *Rhodococcus rhodochrous.*

35. The process of claim 1, wherein the bacterial culture is *Bacillus sphaericus.*

36. A counter-current decantation process for the extraction and recovery of bitumen from tar sands which comprises:

providing a series of interconnected stages extending from a first stage through at least one intermediate stage to a last stage, each of said stages having a mixer associated therewith, said process comprising:

feeding water and raw tar sands to a mixer to form a substantially uniform aqueous tar sands mixture thereof;

passing said tar sands mixture to a flotation cell;

injecting air into said felon cell to form a bitumen froth;

removing and passing said bitumen froth to a deaerator to form a deaerated froth;

passing said deaerated froth to a primary mixer to form a substantially uniform mixture thereof which is fed to a primary settler and thereby form an overflow of dilute bitumen which is removed and collected and an underflow comprising solids, asphaltenes and residual bitumen;

passing said underflow from said primary settler to a secondary mixer to form a uniform mixture thereof which is fed to a secondary settler to form an overflow containing bitumen which is fed to the primary mixer for further recovery and an underflow which is fed to a tertiary mixer, adding a solvent to said tertiary mixer to form a mixture with said underflow from said secondary settler, the mixture being then fed to a tertiary settler to provide an overflow containing bitumen which is fed to said secondary mixer and an underflow which is fed to a first reservoir to provide gravity separation of said underflow into several layers comprising (1) a top layer of dilute bitumen, (2) an intermediate layer containing dilute bitumen, precipitated asphaltenes and water, and (3) a bottom layer comprised of water and solids phase which is filtered and said solids sent to tails;

passing said top layer containing dilute bitumen to said primary mixer for the subsequent recovery of bitumen therefrom;

dividing said intermediate layer into two streams, one being fed to secondary gravity separation in a second reservoir and the other bio chemically treated to form a bioliquor for recycle into the countercurrent decantation process, said secondary gravity separation providing a first layer of floating asphaltenes which is sent to asphaltenes tails, a second layer comprising a bioliquor phase which is recycled to asphaltenes treatment in the asphaltenes separation process, and a bottom layer of clay and sand which is discarded as tails.

* * * * *